US005301592A

United States Patent [19]

Johnston

[11] Patent Number: 5,301,592

[45] Date of Patent: Apr. 12, 1994

[54] BASS DRUM FOOT PEDAL

[76] Inventor: Darrell N. Johnston, 23206 S. Normandie Ave. #7, Torrance, Calif. 90502

[21] Appl. No.: 715,626

[22] Filed: Jun. 14, 1991

[51] Int. Cl.[5] ..... G10D 13/02

[52] U.S. Cl. ..... 84/422.1; 84/723

[58] Field of Search ..... 84/422.1, 723

[56] References Cited

U.S. PATENT DOCUMENTS

| | | | |
|---|---|---|---|
| 4,819,536 | 4/1989 | Lombardi | 84/422.1 |
| 4,829,874 | 5/1989 | Hoshino | 84/422.1 |
| 4,905,565 | 3/1990 | Hoshino | 84/422.3 |
| 4,945,802 | 8/1990 | Ruprecht | 84/422.1 |
| 4,955,277 | 9/1990 | Carlson | 84/422.1 |
| 5,090,289 | 2/1992 | Holcomb | 84/422.1 |
| 5,105,706 | 4/1992 | Lombardi | 84/422.3 |

OTHER PUBLICATIONS

Rick Van Horn, "Axis and Axis-E Pedals", Feb. 1991, Modern Drummer pp. 48-49.

*Primary Examiner*—William M. Shoop, Jr.
*Assistant Examiner*—Helen Kim
*Attorney, Agent, or Firm*—Fulwider, Patteon, Lee & Utecht

[57] ABSTRACT

An improved bass drum foot pedal having a variable drive lever linkage with variable arc ratios connecting the foot pedal to the beater arm and having an electronic device actuator carried by a beater support member and adjustable to vary the impact force and strike point of the actuator, said actuator being operable with or without said pedal being attached to a drum.

2 Claims, 3 Drawing Sheets

BASS DRUM FOOT PEDAL

BACKGROUND

1. Field of Invention

This invention relates to foot pedals for bass drums and is particularly directed to improved bass drum foot pedals having adjustable drive action and which are capable of use with or without electronic enhancement.

2. Prior Art

Foot pedals have long been used for striking bass drums, since the use of a foot pedal frees both of the drummer's hands for use with snare drums, cymbals or other devices. However, most prior art bass drum pedals have been constructed with a fixed drive action. This means that the drummer must vary the force with which the beater impacts the drum head by varying the force applied by the drummer's foot. Unfortunately, some drummers have a "heavier foot" than others and, hence, must constantly guard against causing the beater to strike the drum head too vigorously, while other drummers have a very "light foot" and, consequently, must exert conscious effort to effect a desired beater impact. Some attempts have been made to provide adjustable drive action. However, the adjustable drive action foot pedals of the prior art have been complex and expensive to produce and have been difficult to adjust and maintain. Furthermore, in recent years, electronic enhancement has become widely popular. As a result, some drummers completely replace the bass drum with electronic devices and use foot pedals to actuate the electronic devices. Alternatively, some drummers use both real bass drums and electronic enhancement devices. However, the actuation mechanisms needed for electronic drum simulators is considerably different that needed for actuating a conventional bass drum beater, although it is desirable that both be operable by means of foot pedals. Consequently, some drummers have chosen to use either real bass drums or electronic devices exclusively, while others have used the two alternatively, having separate pedals for actuating the respective types of drum. Still others have attempted to combine the actuation mechanisms for both the real bass drums and the electronic devices. However, most of the prior art combination actuators have provided unbalanced results, with either the real drum or the electronic device being too loud. Thus, none of the prior art bass drum foot pedals have been entirely satisfactory.

BRIEF SUMMARY AND OBJECTS OF INVENTION

These disadvantages of prior art bass drum pedals are overcome with the present invention and an improved bass drum pedal is provided which has a variable drive action which is simple and economical to produce, which is readily adjustable to accommodate a wide variety of foot strengths and which can be used equally well to actuate real drums, electronic devices or both.

The advantages of the present invention are preferably attained by providing an improved bass drum foot pedal having a lever linkage adjustably connecting the foot pedal to the beater arm and having an electronic device actuator means carried by the beater support member and adjustable to vary the impact force and strike point of the actuator.

Accordingly, it is an object of the present invention to provide an improved bass drum foot pedal.

Another object of the present invention is to provide an improved bass drum foot pedal which is readily adjustable to accommodate a wide variety of foot strengths.

A further object of the present invention is to provide an improved bass drum foot pedal having an adjustable drive action.

An additional object of the present invention is to provide an improved bass drum foot pedal which is simple and economical to produce and which is easy to adjust and maintain.

Another object of the present invention is to provide an improved bass drum foot pedal which is equally useful with real drums, electronic devices or both.

A specific object of the present invention is to provide an improved bass drum foot pedal having a lever linkage adjustably connecting the foot pedal to the beater arm and having an electronic device actuator means carried by the beater support member and adjustable to vary the impact force and strike point of the actuator, said actuator being operable with or without said pedal being attached to a drum.

These and other objects and features of the present invention will be apparent from the following detailed description, taken with reference to the figures of the accompanying drawing.

DETAILED DESCRIPTION OF THE INVENTION

Figure 1:
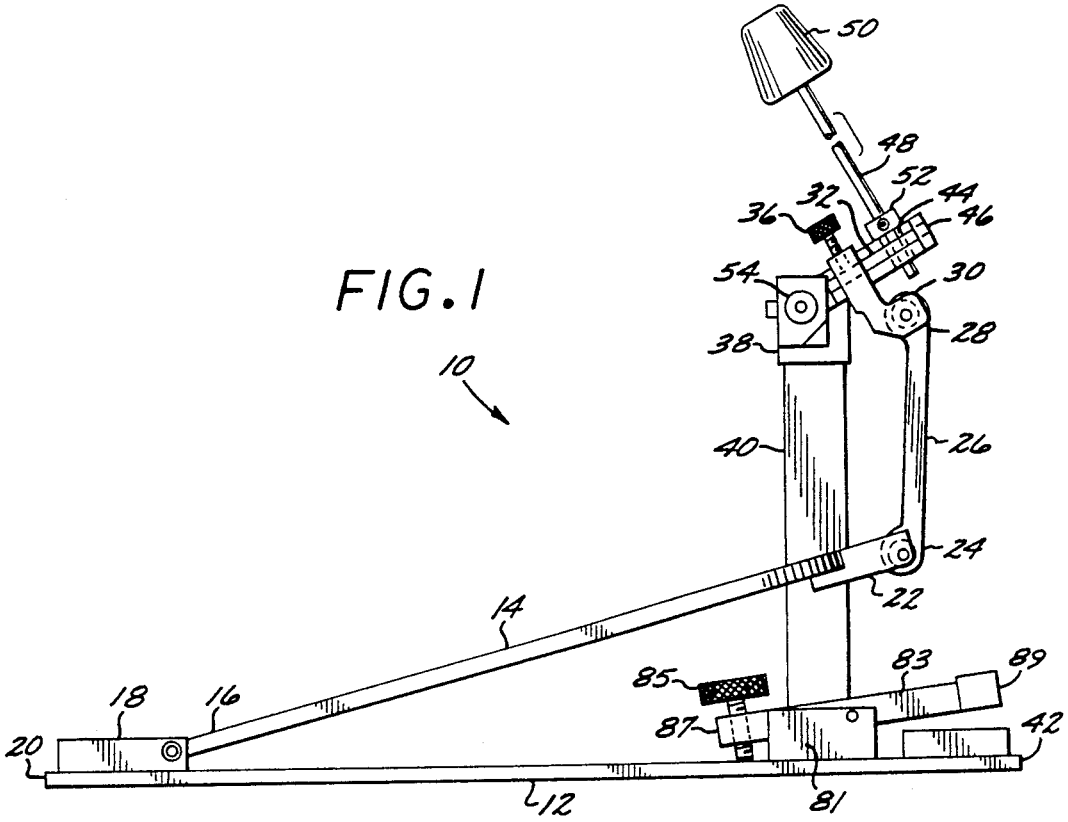
FIG. 1 is a right side view of a bass drum foot pedal embodying the present invention.
Figure 2:
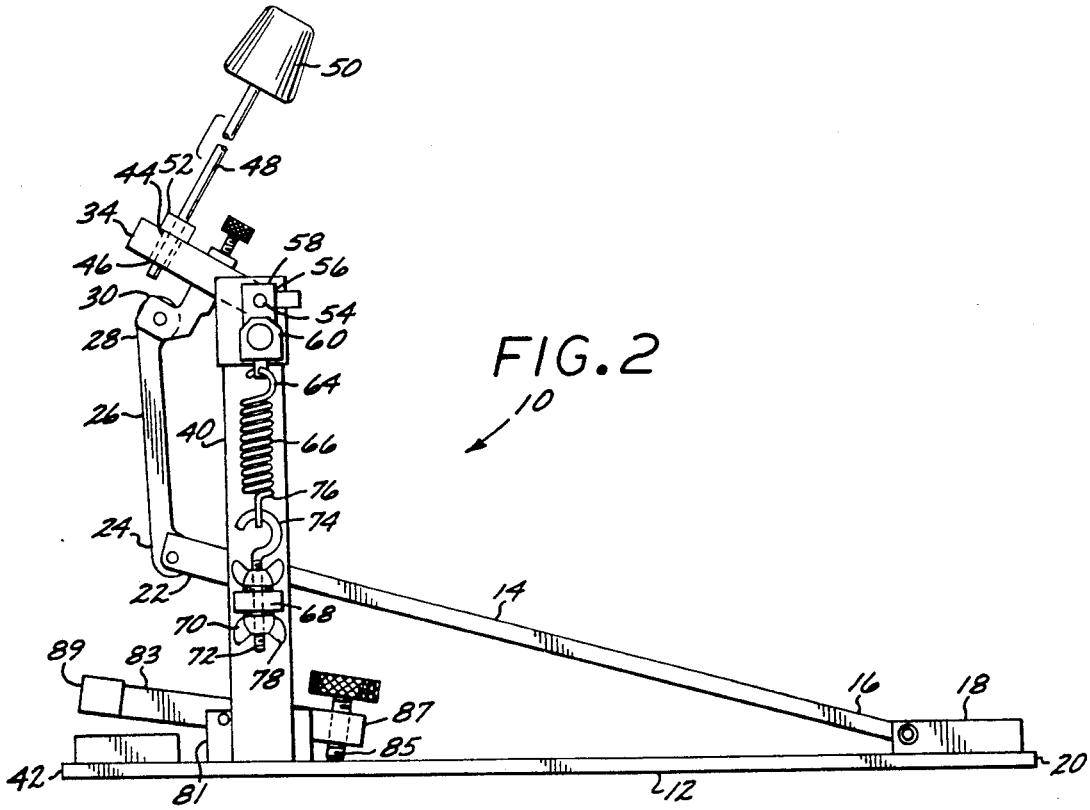
FIG. 2 is a left side view of the bass drum foot pedal of FIG. 1.

In that form of the present invention chosen for purposes of illustration, FIG. 1 shows a bass drum foot pedal, indicated generally at 10, having a flat elongated base 12 with a foot pedal 14 having one end 16 pivotally secured to a block 18 located adjacent one end 20 of the base 12. The opposite end 22 of the foot pedal 14 is pivotally secured to the lower end 24 of a link member 26 whose upper end 28 is pivotally secured to the lower end of a slide member 30. The slide member 30 is movable along a rod 32 carried by a rocker member 34 and may be secured in a desired position along the rod 32 by suitable means, such as thumbscrew 36. The rocker member 34 is pivotally mounted adjacent the upper end 38 of a column 40 which is fixedly mounted adjacent the forward end 42 of the base 12 and extends vertically upward therefrom. The rocker member 34 is formed with a hole 44 extending therethrough adjacent the outer end 46 of the rocker member 34 to releasably receive the shaft 48 of a suitable beater 50. Clamp means 52 are mounted on the rocker member 34 adjacent the hole 44 to releasably retain the shaft 48 of the beater 50. The rocker member 34 is pivotally mounted on the column 40 by a pivot arm 54 which extends through the upper end 38 of the column 40 and carries a link member 56 on its opposite end 58 and a second link member 60 is pivotally connected between the lower end 62 of link member 56 and the upper end 64 of a spring 66. A flange 68 projects laterally from the column 40 and has an opening 70 extending therethrough to receive the shank 72 of a hook 74 which retains the lower end 76 of the spring 66. A thumbnut 78 serves to permit adjustment of the tension applied by hook 74 to the spring 66 and to retain the hook 74 in a desired position of adjustment. Link member 56 is secured in a desired position of adjustment about the pivot arm 54 by means of a set screw 80 or the like. Finally, a block 81 is mounted on the base 12 adjacent the forward end 42 thereof and an arm 83 is pivotally mounted thereon with a screw 85 threadedly carried adjacent the rear end 87 of arm 83 and clamping means 89 is provided adjacent the opposite end of arm 83 to clamp the bass drum pedal 10 to the rim of a bass drum, not shown.

Figure 3:
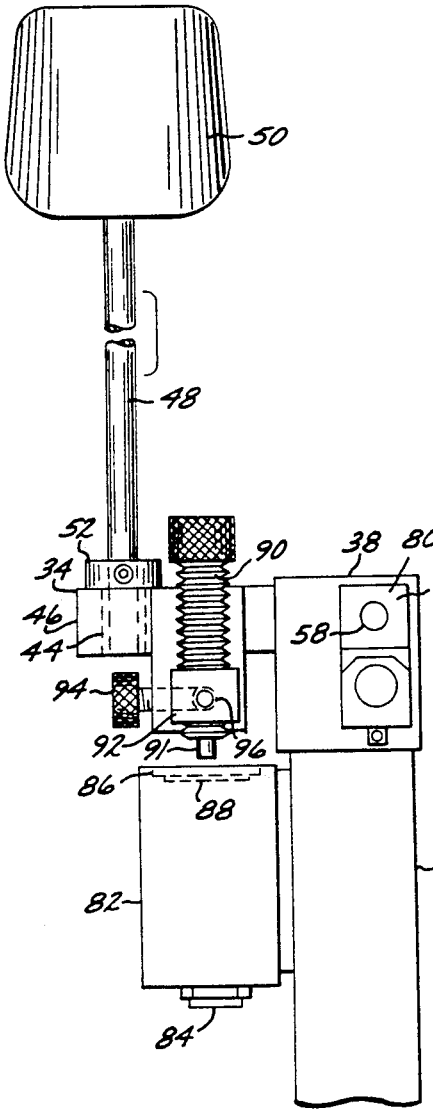
FIG. 3 is an enlarged detail side view of a portion of the bass drum foot pedal of FIG. 1, with parts removed for clarity, showing an electronic device actuation mechanism mounted on the bass drum foot pedal of FIG. 1.
Figure 4:
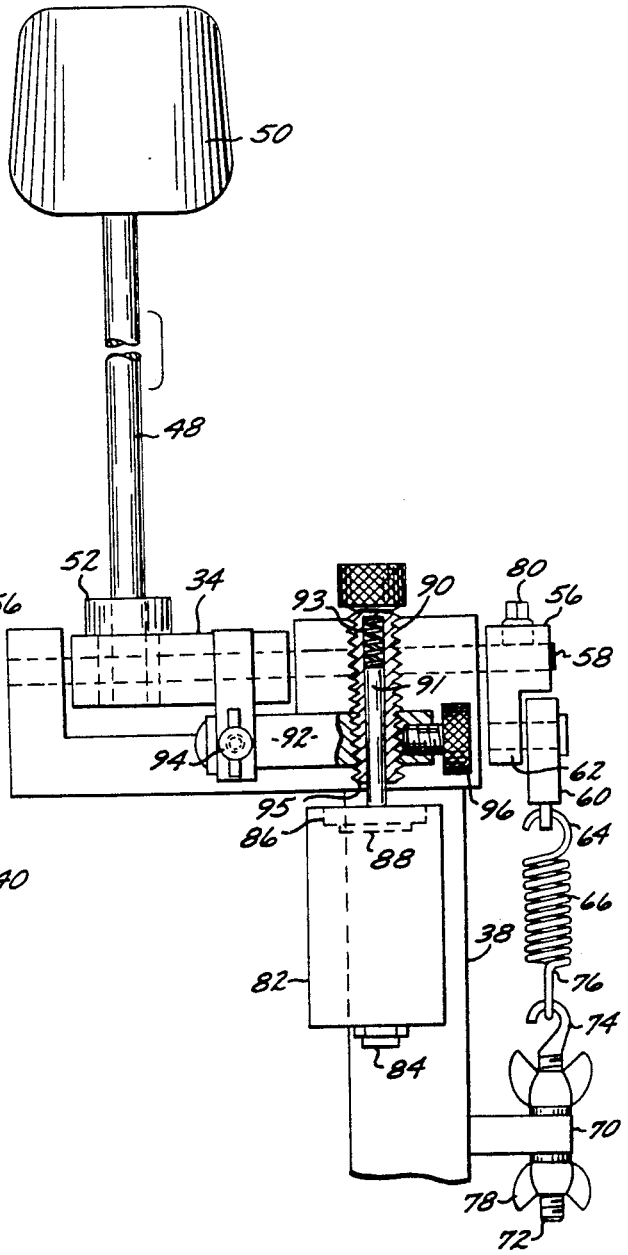
FIG. 4 is a view similar to that of FIG. 3, showing a front view of the electronic device actuation mechanism of FIG. 3.

To actuate electronic apparatus, an actuator box 82 may be mounted on the column 40, as seen in FIGS. 3 and 4, and may be connected to the electronic apparatus by wires 84 or the like. As is well known, the actuator box 82 has an opening 86 in the upper surface thereof within which is mounted a transducer 88 that converts mechanical energy into electrical signals and, hence, provides an electrical signal indicative of when and with what force the transducer 88 is struck. A striker 90 is carried by an arm 92 which projects laterally from the rocker member 34 adjacent the outer end 46 thereof. The arm 92 is rotatably mounted on the rocker member 34 and may be secured in a desired rotational position by set screw 94 or the like. The striker 90 is a tube containing a striker arm 91 which is normally urged downwardly by spring 93 to project through opening 95 in the bottom of striker 90. This permits arm 91 to resiliently engage the transducer 88 without damaging the transducer 88. The striker 90 is threadedly mounted in the arm 92 to permit adjustment of the length of the striker 90 and suitable means, such as set screw 96, serves to releasably secure the striker 90 in a desired position of adjustment.

In use, the drummer clamps the base drum pedal 10 to the rim of a bass drum, not shown, by adjusting set screw 85, as discussed above, and depresses the pedal 14 until the beater 50 engages the drum head. He then adjusts the force required to operate the pedal 14, by adjusting the position of slider member 30 along rod 32 of rocker 34 and by adjusting the rotational position of link 56 on pivot arm 54 and the tension on spring 66 by means of thumbnut 78. If electronic apparatus is to be employed in addition, the drummer also adjusts the length of striker 90, by means of set screw 96, and the rotational position of arm 92, by means of set screw 94, to assure that the striker 90 impacts the transducer 88 simultaneously with, and with the same impact force, as that with which the beater 50 strikes the drum head, not shown.

Figure 5:
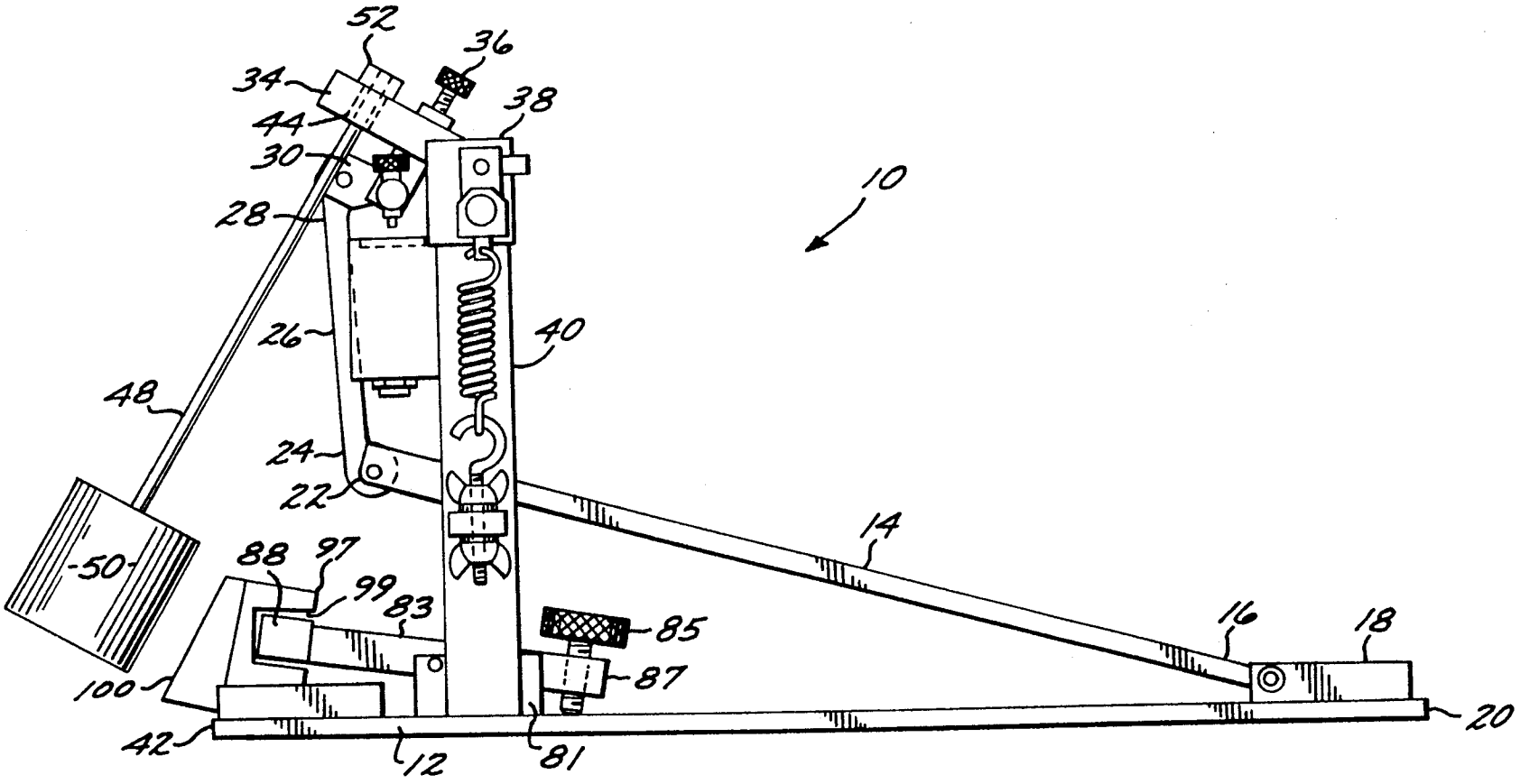
FIG. 5 is a view, similar to that of FIG. 1, showing the bass drum foot pedal of FIG. 1 arranged for use to actuate an electronic drum device only.

FIG. 5 shows an alternative arrangement of the bass drum foot pedal 10 for use where electronic apparatus is to be actuated, but no actual drum is to be used. In this form of the present invention, a striker block 97, formed with a recess 98 and carrying a resilient cushion 100, is clamped to the base 12 by inserting the end of arm 83 into the recess 98 and adjusting screw 85 of the clamping means 89. Thereafter, shaft 48 of the beater 50 is removed from hole 44 of the rocker 34 and is reinserted so as to project downwardly from the rocker 34, as seen in FIG. 5, and is clamped in this position by thumbscrew 36.

In use, the drummer depresses the pedal 14 until the beater 50 engages the resilient cushion 100 of the striker block 96 and adjusts the tension on the pedal 14 and the position of the striker 90 in the manner described above.

Obviously, numerous variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A bass drum pedal comprising:

a base;

a foot pedal having one end pivotally secured to a front end of said base;

a column connected to said base adjacent to the opposite end of said base from said front end and extending longitudinally above said base;

a rocker arm pivotally mounted to said column and adjacent to the upper end of said column;

linkage means for linking said foot pedal to said rocker arm to actuate said rocker arm in response to a force applied to said foot pedal and adjustably coupled therebetween to permit selective positioning along said rocker arm;

bias means for biasing said rocker arm to said column and adjustably coupled therebetween to permit selective control of the force required for said foot pedal to move said rocker arm;

said bias means includes a spring connected between said column and said rocker arm;

a beater having a shaft releasably secured in said rocker;

a transducer mounted on said column and operative to generate electrical signals in response to receiving a strike force wherein said electrical signals are indicative of the strike force applied thereto;

striker means carried by said rocker for striking said transducer in response to said rocker being moved by said foot pedal.

2. The bass drum pedal of claim 1 wherein:

length adjustment means for adjusting the length of said striker; and radial adjustment means for radially adjusting said striker with respect to said rocker.

* * * * *

UNITED STATES PATENT AND TRADEMARK OFFICE

CERTIFICATE OF CORRECTION

PATENT NO. : 5,301,592

DATED : April 12, 1994

INVENTOR(S) : Darrell N. Johnston

It is certified that error appears in the above-identified patent and that said Letters Patent is hereby corrected as shown below:

Column 4, line 48, after "rocker" insert --arm--;

line 53, after "rocker" insert --arm--;

line 54, after "rocker" insert --arm--;

line 56, delete "wherein" and insert

--further comprising--;

line 58, after "striker" insert --means--;

line 60, after "rocker" insert --arm--.

Signed and Sealed this

Twenty-third Day of August, 1994

Bruce Lehman

*Attest:*

BRUCE LEHMAN

*Attesting Officer*

*Commissioner of Patents and Trademarks*